United States Patent [19]

Wattiez et al.

[11] Patent Number: 4,494,264

[45] Date of Patent: Jan. 22, 1985

[54] ELEMENT PERMITTING TO WASH DIFFERENT TEXTILE ARTICLES IN THE SAME BATH AND WASHING METHOD USING SAID ELEMENT

[75] Inventors: Daniel Wattiez, Lozanne; Jean-Claude Hennion, Mons-en-Baroeul, both of France

[73] Assignee: Institut Textile De France, Bourlogne sur Seine, France

[21] Appl. No.: 512,529

[22] Filed: Jul. 11, 1983

[30] Foreign Application Priority Data

Jul. 20, 1982 [FR] France ..... 82 12851

[51] Int. Cl.[3] ..... D06F 35/00

[52] U.S. Cl. ..... 8/150; 68/235 R; 383/102

[58] Field of Search ..... 8/150; 68/235 R; 383/86, 102, 117; 428/35

[56] References Cited

U.S. PATENT DOCUMENTS

| | | | |
|---|---|---|---|
| 2,133,584 | 10/1938 | Spanel | 68/235 R |
| 2,426,843 | 9/1947 | Phair . | |
| 2,550,697 | 5/1951 | Kintner | 383/102 X |
| 2,555,561 | 6/1951 | Whitheap | 383/117 X |
| 2,602,482 | 7/1952 | Lyon . | |
| 2,789,610 | 4/1957 | Pritchard . | |
| 3,036,616 | 5/1962 | Allen . | |
| 3,331,221 | 7/1967 | Lawson, Jr. | 383/102 X |
| 3,673,110 | 6/1972 | Edwards . | |
| 3,694,364 | 9/1972 | Edwards . | |
| 3,769,819 | 11/1973 | Contreras | 68/235 R |
| 4,170,565 | 10/1979 | Flesher . | |
| 4,388,739 | 6/1983 | Martinon et al. | 8/150 |

FOREIGN PATENT DOCUMENTS

| | | |
|---|---|---|
| 0033815 | 7/1982 | European Pat. Off. . |
| 1585665 | 1/1970 | France . |

*Primary Examiner*—Philip R. Coe
*Assistant Examiner*—Frankie L. Stinson
*Attorney, Agent, or Firm*—Parkhurst & Oliff

[57] ABSTRACT

The invention relates to an element permitting to simultaneously wash in the same bath two types of textile articles, the articles of the first type being dyed with dyes liable to run in the washing bath and to settle on the articles of the second type. The element according to the invention is in the form of a filtering envelope inside which one of the types of textile articles is enclosed, the envelope being made in a material having more tinctorial affinity towards the dyes liable to run in the bath than the articles of the second type.

8 Claims, 1 Drawing Figure

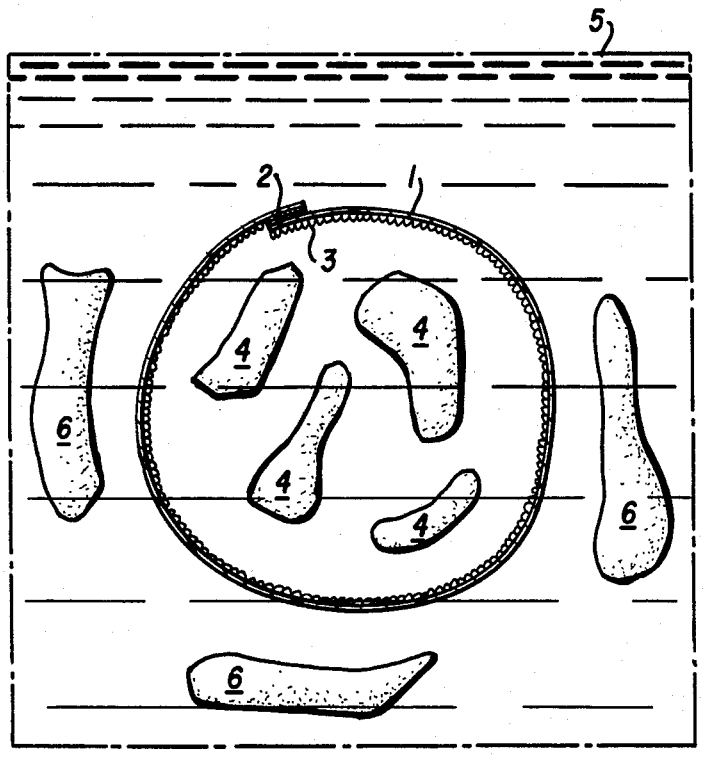
5
2
1
3
4
4
4
4
6
6
6

ELEMENT PERMITTING TO WASH DIFFERENT TEXTILE ARTICLES IN THE SAME BATH AND WASHING METHOD USING SAID ELEMENT

The present invention relates to an improvement in techniques for washing textile articles in conventional washing machines.

It relates more particularly to a novel accessory, designated hereinafter as "element", permitting to wash simultaneously in the same bath, a mixture of articles which are liable to become discolored during the washing cycle, the dyes, spreading through the washing bath, being liable to run on the other articles.

Amongst the problems arising with washing machines, one of the main ones is the problem of washing dyed articles. Indeed, in a lot of cases, the lack of fastness of certain colors causes the dyes to diffuse into the washing bath and very often to settle on the other articles.

For this reason, it is in most cases necessary, prior to washing, to sort out the articles, separating the white or light-colored articles from the dark-colored ones, and to wash them in two separate machines, and not simultaneously.

Different solutions have been tried until now to solve the problem of running dyes diffusing through the bath, but a solution has never been proposed which, on the one hand, will solve this problem, and on the other hand, will make it possible to wash simultaneously in the same bath, two types of textile articles, the articles of the first type being dyed with dyes which are liable to run in the washing bath and to settle on the articles of the second type.

It has also been proposed, in U.S. Pat. No. 2,426,843 to simultaneously wash different articles in the same bath by using storage bags adapted for each type of articles to be washed, considering that it is an admitted fact that white articles need to be more intensively washed than printed or light-colored articles, which latter need to be more intensively washed than dark-colored articles.

To solve this problem, it is described in the aforesaid U.S. patent to divide the articles into batches (white-light colors-dark colors) and to place each of the resulting batches in mesh bags of different porosity, the said porosity being greater if the article contained inside the bag is light-colored. As a result, the volume of wash water passing through the bag will be proportional to the porosity of the meshes.

Such a solution thus permits to wash articles of different nature in the same bath, but it does not solve the problem of how to eliminate the phenomenon of re-deposition of the dyes which are liable to run in the bath.

European Pat. No. EP-A-0033 815 describes a means which is designed to prevent the re-deposition of the dyes running in the washing bath, this means consisting in introducing in the washing machine, mixed together with the articles to be washed, one article presenting a particular affinity for dyes.

It has however been found that this method was not entirely satisfactory due to the fact that depending on the quantity of articles placed inside the machine and on the position amongst these articles of the article designed to absorb the dyes, it was impossible for a re-application of the dyes to occur. This is explained by the fact that the element designed to absorb the dyes has not a fixed and stable position with respect to the articles to be washed and that if it should become caught in the middle thereof, this would limit its possibility to act as a "dye-pumping" member.

Amongst the other solutions which have been proposed to solve the problem of dyes re-deposition, it has been proposed, as described in U.S. Pat. No. 3,694,364 to incorporate to the washing bath additives designed to prevent such re-deposition. This particular solution considerably increases washing costs and moreover, excludes the possibility of simultaneously washing a mixture of articles, some of which are liable to lose their color whilst the others are liable to absorb the dyes which have run in the bath.

An element has now been found, and this is the object of the present invention, which, in simple, efficient and inexpensive manner, enables to overcome the disadvantages of the prior solutions and to wash simultaneously, in the same bath, two types of textile articles, the articles of the first type being dyed with dyes liable to run in the washing bath and to deposit on the articles of the second type.

Generally speaking, the element according to the invention which gives the aforesaid result, is characterized by the fact that it is in the form of a filtering envelope in which one of the two types of textile articles are enclosed, said envelope being made from a material which has a tinctorial affinity for the dyes liable to run in the washing bath, greater than the tinctorial affinity of the type of articles on which the running dye is liable to settle, and the porosity of said envelope being such that the washing water can traverse it freely whilst allowing a long enough contact with the washing for the dyes to settle on that envelope, and thus preventing the dye from re-depositing.

The material used to produce an envelope-shaped element according to the invention will be selected as a function of the more commonly used dyes. Preferably, it will be a material showing ion-exchanging properties with respect to dyes in the ionic state, especially as most conventional dyes are in that form. Such properties can be obtained for example by grafting. The element according to the invention may be made from grafted cellulose with ion-exchanging functions, the ions being obtained for example as described in French Pat. No. 1 586 665.

Moreover, the envelope-shaped element may be made from a fabric, a knitted material, or any other like textile structure (non-woven for example). Said element will be produced in such a way as to allow not only a free circulation of the washing bath, but also a long enough contact time permitting to the envelope to hold back the dyes contained in the washing bath.

It has been found that the aforesaid characteristics could be obtained by producing an envelope with a wide specific surface on at least one of its faces, by for example forming said envelope from a looped-type knitted material, produced in conventional manner, the said loops being either inside the envelope or outside.

Obviously, other types of textile structures showing high tinctorial affinity and appropriate porosity could also be used without departing from the scope of the invention.

Good results have been obtained when producing the envelope from a honeycomb-structure material, of the type such as normally used for producing floor-cloths.

The envelope according to the invention comprises temporary closure means permitting the introduction of one of the types of linen to be washed, said closure means being of the adhesive strips type, commercialized under the trademark "VELCRO", or a lacing system, or else a structure similar to that of a pillow-slip, i.e. in which two flaps defining an opening are superimposed and permit an easy introduction of the articles whilst giving it sufficient holding power.

The invention will be more readily understood on reading the following examples of embodiment given by way of illustration and non-restrictively.

EXAMPLE 1

The envelope-shaped element according to the invention is designed as a bag (1) comprising closure means (2) constituted for example by strips commercialized under the trademark "VELCRO" and permitting to close the filled bag.

In this particular example, the envelope (1) is made from a conventional towelling material weighing 230 g/m$^2$ and in which the loops (3) confer to the material a wide specific surface and are on the inside of the envelope.

This material is produced on a conventional loom and comprises a 27 yarn/cm warp, and a 15 yarns/cm weft. Its thickness is in average 5 mm.

To produce this towelling material, cotton yarns are used which are previously grafted as described in French Pat. No. 1 585 665. It contains, as a result, quarternary ammonium groups up to a rate of nitrogen of 0.5%, this corresponding to a grafting rate of about 5%.

Because of its ion-exchanging properties, this type of grafted cotton shows great affinity towards the dyes of acid type commonly used for dyeing wool or polyamides, or towards the direct dyes used for dyeing cotton. These dyes which are not very fast dyes, have a tendency to run during a wash in washing machines.

A bag (1) is made with this type of towelling material which bag weighs 400 grammes. The exchanging capacity of the grafted material, namely the number of ions likely to be fixed by volume unit is 0.3 milliequivalent per gramme (0.3 meq/g), the bag so produced having a total capacity of 120 meq.

Inside the aforesaid hermetically-closed bag are placed 400 g of a white cotton article (4). The bag so filled is introduced in a washing machine (5) together with articles in dyed cotton (6). In this particular example, 400 g of dyed cotton (6) are used, the dyeing being effected at a rate of 2% using a direct dye, known under the name CI direct Blue 1, which is a pure diazol blue GB of molecular weight 990, and having four sulphonate functions.

Having done so, a conventional for such articles washing cycle is conducted. During this cycle, the bleeding of the dyed material (6) can reach up to 20% of the quantity of dye intially fixed on the said material. Therefore, for 400 g of such dyed article, it is 8 grammes of the initially fixed dye, and 1.6 g which, during the washing operation, are liable to run in the water.

It has been found that after washing, there is no redeposition of the dye on the white article (4) contained inside the envelope (1) and that the article (4) had been perfectly washed and not been in the least polluted. The external surface of the towelling material constituting the envelope (1), on the contrary, is at the end of the washing cycle, very dark blue, whereas its inner surface is light blue.

Besides its high efficiency, this particular bag can be used several times, more than fifteen consecutive washes being possible before it shows signs of losing its efficiency.

EXAMPLE 2

For comparison's sake, a second bag is produced, similar to the preceding one, but based on non-grafted cotton, meaning that, unlike in the invention, it shows no greater tinctorial affinity for the dyes expected to run in the wash than the articles to be washed.

Like in the preceding example, an article in white cotton is placed inside the bag, and a dyed cotton article outside.

After the wash, the bag is non-grafted towelling coming out of the machine is of a uniform sky-blue color, the cotton material that it contains being of the same color as said bag. Therefore, the dye which has run in the treatment bath has spread uniformly on both the envelope and the article to be washed.

EXAMPLE 3

Example 1 is repeated except that the bag (1) is not produced from a loop knitting but from a non-woven material, weighing 60 g/m$^2$ and containing about 75 to 80% viscose.

This material is also grafted in the same way as in example 1 and presents pores of diameter about 0.07 mm.

With a bag comprising only one layer of such a material, the washing is conducted as in example 1, it is noted that there is undoubtedly a good circulation of the washing bath but, on the other hand, a certain quantity of the dye running in the wash, stains the white cotton samples.

If on the contrary, the bag is constituted of two superimposed layers of such a non-woven material, the samples are brought out in a perfectly washed state, the white samples not being stained and the dye which has run being absorbed by the filtering envelope.

This example therefore shows that the envelope which permits to best perform the invention, should, not only show good tinctorial affinity and good porosity, it should also ensure a long enough contact time with the washing bath for the dyes to spread therein, thus permitting to said dyes to settle on said envelope.

EXAMPLE 4

Example 1 is repeated, the bag (1) being made from a honeycombed material weighing 600 g/m$^2$, material commonly used for producing floor-cloths and containing about 75% cellulose fibers.

This material is also grafted as indicated in Example 1.

Its thickness is variable because of its structure, and can be about 6 mm. It further comprises pores of substantially rectangular shape, the dimensions of which are about 0.2 mm width and 10 mm length.

As in Example 1, a particularly good wash is obtained, the white samples not being contaminated by the dyes which have run in the bath, said dyes having been completely absorbed by the filtering envelope.

The foregoing examples do show the advantages brought by the invention, in particular the fact that it is possible, simply and economically, to wash simultaneously in the same bath, a mixture of articles, some of which are liable to lose their color during the washing cycle.

Obviously, the invention is not limited to the examples given hereinabove, and on the contary covers any variants that can be brought thereto without departing from the scope or the spirit thereof.

For example, it would be possible to use other materials besides grafted cotton to produce the protection envelope. Also, the colored articles can be placed either inside the envelope, or outside. As indicated hereinabove, the envelope will preferably have a very wide specific surface in order to ensure a long enough contact with the washing liquid whilst permitting a good circulation of said liquid.

What we claim is:

1. An element permitting to simultaneously wash in the same bath two types of textile articles, the articles of the first type being dyed with dyes which are liable to run in the bath and to settle on the articles of the second type, wherein said element is in the form of a filtering envelope in which one of the two types of textile articles are enclosed, said envelope being made from a material which has a tinctorial affinity for the dyes liable to run in the washing bath, greater than the tinctorial affinity of the type of articles on which the running dye is liable to settle, and the porosity of said envelope being such that the washing water can traverse it freely while allowing a long enough contact with the washing for the dyes to settle on that envelope, and thus preventing the dye from re-depositing.

2. An element as claimed in claim 1, wherein said element is equipped with closure means permitting to introduce the articles and keep them inside the said element.

3. An element as claimed in claim 2, wherein the closure means are constituted by strips such as those commercialized under the mark "VELCRO".

4. A material as claimed in claim 2, wherein the closure means are constituted by two superimposed flaps.

5. An element as claimed in claim 1, wherein said element is made in a material presenting ion-exchanging properties towards dyes in the ionic state.

6. An element as claimed in claim 5, wherein the ion-exchanging properties are obtained by grafting treatment.

7. An element as claimed in claim 1, wherein said element is made in a loop material, the loops being either on the inside or on the outside of the envelope.

8. A method permitting to simultaneously wash in the same bath a mixture of textile articles some of which are liable to lose their color during the washing cycle, wherein one of the types of articles, of which the dye is liable to run in the washing bath is isolated from the other type of articles liable to be contaminated by said dye, the separation of the two types of articles being made by way of a filtering element, in the form of a closed envelope, said envelope being made of a material showing more tinctorial affinity for the dyes liable to run in the washing bath than the articles which the running dye is liable to stain.

* * * * *